United States Patent [19]

Moulton

[11] 4,140,001

[45] Feb. 20, 1979

[54] POWER CRIMPING TOOL

[76] Inventor: Thomas D. Moulton, Rte. 1, Box 324, Esparto, Calif. 95627

[21] Appl. No.: 872,805

[22] Filed: Jan. 27, 1978

[51] Int. Cl.[2] ..... B21J 9/18

[52] U.S. Cl. ..... 72/416; 72/451; 72/453.03

[58] Field of Search ..... 72/451, 450, 412, 416, 72/453.03, 470, 416, 451, 453.03; 100/271, 272

[56] References Cited

U.S. PATENT DOCUMENTS

| | | | |
|---|---|---|---|
| 800,508 | 9/1905 | Stambaugh | 72/453.03 |
| 2,162,133 | 6/1939 | Spire | 100/271 |
| 2,443,573 | 6/1948 | Brundage | 100/271 |
| 3,577,591 | 5/1971 | Ricard | 100/271 |
| 3,842,651 | 10/1974 | Shaffer | 72/451 |
| 3,929,035 | 12/1975 | Cohn | 192/131 |

*Primary Examiner*—C.W. Lanham
*Assistant Examiner*—Gene P. Crosby
*Attorney, Agent, or Firm*—Lothrop & West

[57] ABSTRACT

A power crimping tool especially for use with a fitting of ring shape having a pair of oppositely extending fins on a ring diameter, has a base on which is an extending anvil with a first planar surface having a first die configuration therein. Pivoted on the base is a lever generally overlying the anvil and having a second planar surface having a second die configuration therein. A power driver on the base connects to the lever through a pair of toggle links having pivot pins interconnecting the toggle links themselves, connecting one of the toggle links to the lever and connecting the other toggle link to an adjustable mount for setting the toggle links slightly away from a straight line in one extreme position and so positioning the first and second planar surfaces a predetermined distance apart. There is a spring for return motion of the lever and there are guides for confining the lever laterally. There is also a protected manual control on the base for regulating the power driver.

7 Claims, 4 Drawing Figures

POWER CRIMPING TOOL

BRIEF SUMMARY OF THE INVENTION

Especially for use with a fitting of ring shape having a pair of extending, diametrical fins, there is provided a power tool resting on a base supporting an extending anvil having an upwardly directed planar surface in which a first die configuration is provided. Pivoted on the base and in a position generally to overlie the anvil is a lever having a lower planar surface in which is provided a second die configuration adapted to cooperate with the first die configuration. A power driver mounted on the base and preferably driven by compressed air is controlled by a manual operator. The operator is carefully guarded for individual, manual operation. The power driver is connected through a toggle mechanism to the lever. Return lever motion is by a spring connected to the lever and to the base. The toggle mechanism includes a pair of toggle links, one being connected by a pivot pin to the power driver, the other being connected by a pivot pin to the lever and the two links being connected together by another pivot pin. An additional pivot pin connects one of the links to an adjusting device including a screw mechanism effective to move the links almost into but actually away from a straight line position in which the upper planar surface and the lower planar surface are spaced a predetermined distance apart.

DETAILED DESCRIPTION

Figure 4:
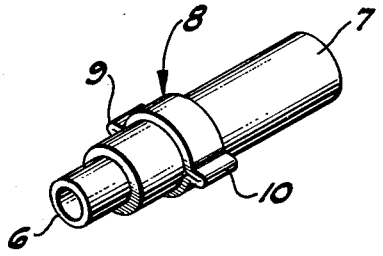
FIG. 4 is an isometric perspective showing a plumbing arrangement having a fitting crimped into operating position thereon as a result of the working of the disclosed tool.

As particularly illustrated in FIG. 4, the present power crimping tool is especially designed for use with an arrangement in which a rigid tube 6, for example, is inserted into a relatively flexible surrounding hose 7. The hose is held in operating position despite internal pressure on the pipe 6 by a fitting 8. This is generally of a circular band or ring-like configuration having at opposite diametrical points a pair of outwardly extending fins 9 and 10. It is a necessity of this type of fitting that it readily go on to the assembled pipe and hose initially with considerable clearance, that it be easily positioned axially and that it be finally crimped into a generally circular configuration tightly pressing the hose onto the pipe 6. The crimping operation results in fins 9 and 10 which are sufficiently deformed and shaped as to resist changes in configuration of the fitting so that the connection of the hose and pipe is permanently made.

The power crimping tool pursuant to the invention and for use with such a fitting as well as others of a suitable nature preferably comprises a base 12 mounted on any appropriate kind of support, not shown, and having not only a bottom plate 13 but also having a pair of spaced side plates 14 and 16 upstanding from the bottom plate and configured to provide an overhanging nose portion 17.

Permanently secured to the base is an anvil 18 preferably made up of a rectangular bar for most of its length fastened to the base 12, for example, by welding, but having a portion outstanding from the plate 12 for a substantial distance so as to underlie the nose portion 17. The anvil has an upper planar surface 19 in which there is provided at least one die configuration 21. This is usually a nearly semicircular-cylindrical depression in the anvil merging smoothly with the planar surface 19 on both sides of the depression. While there may be only one such configured surface, it is easy to supply also another die configuration 22 of the same general shape but of a smaller size and even a third die configuration 23 of a similar contour but of a smaller size.

Designed to cooperate with the anvil 18 is a lever 26 also of rectangular bar stock, preferably, and at one end mounted on a pivot shaft 27 between a pair of upstanding ears 28 secured at their bottom to the plate 13 so that the lever 26 is substantially above the anvil and can swing toward and away from the anvil. The lever 26 also extends away from the side plates 14 and 16, being also substantially beneath the overhanging nose portion 17.

The lever is guided in a vertical plane and is held against lateral displacement by a pair of upstanding guides 29 secured to the anvil 18. The outstanding portion of the lever 26 has a lower second planar surface 31 in which is formed at least one die configuration 32. This is conveniently symmetrical with and in general registry, in one position of the parts, with the die configuration 21. Also formed in the second planar surface 31, if desired, is another die configuration 33 of a smaller diameter and there may also be a still further die configuration 34 in the planar surface 31 but even smaller than the preceding ones, matching those in the anvil.

In order to move the lever 26 with respect to the base, there is afforded a power driver 36 of standard manufacture having the customary mountings 37 to a cross strap 38 forming part of the frame 12 and serving not only as a mounting for the power driver but also as a brace for the base. The power driver has a projecting rod 39 ending in a clevis 41 positioned adjustably on the stem 39 and held by a lock nut 42. Conveniently, the power driver 36 is pneumatically operated and has a connecting hose 43 extending to any suitable source of air under pressure through a control valve 44 appropriately mounted to the base through the side panel 16. The control valve 44 is a standard unit joined to the compressed air source through a line 46 and appropriate fittings.

The valve has a control button 47 that is spring returned and is actuable by a plate 48 secured to the control by a pin mounting 49. The plate 48 is designed to be manually actuated, preferably by the user's finger. The plate 48 is especially guarded by an overlying shape 51 secured to the frame, leaving just sufficient space for the user's finger to be introduced and pressed against the plate 48 but shielding the plate 48 from accidental dislodgment by falling objects, bumping or the like.

When the plate 48 is depressed, compressed air expands the power driver 36 and projects the rod 39 and the clevis 41. To take advantage of that rod motion to move the lever 26 relative to the anvil 18, the clevis 41 is connected by a first pivot pin 61 to first toggle link 62. A second toggle link 63 is paired and is connected by a second pivot pin 64 to the lever 26 and the toggle links 62 and 63 are joined together by a third pivot pin 66. The links 62 and 63 are so mounted and are so movable that the first pivot pin 61, the second pivot pin 64 and the third pivot pin 66 are movable into and out of some special relationships.

Figure 2:
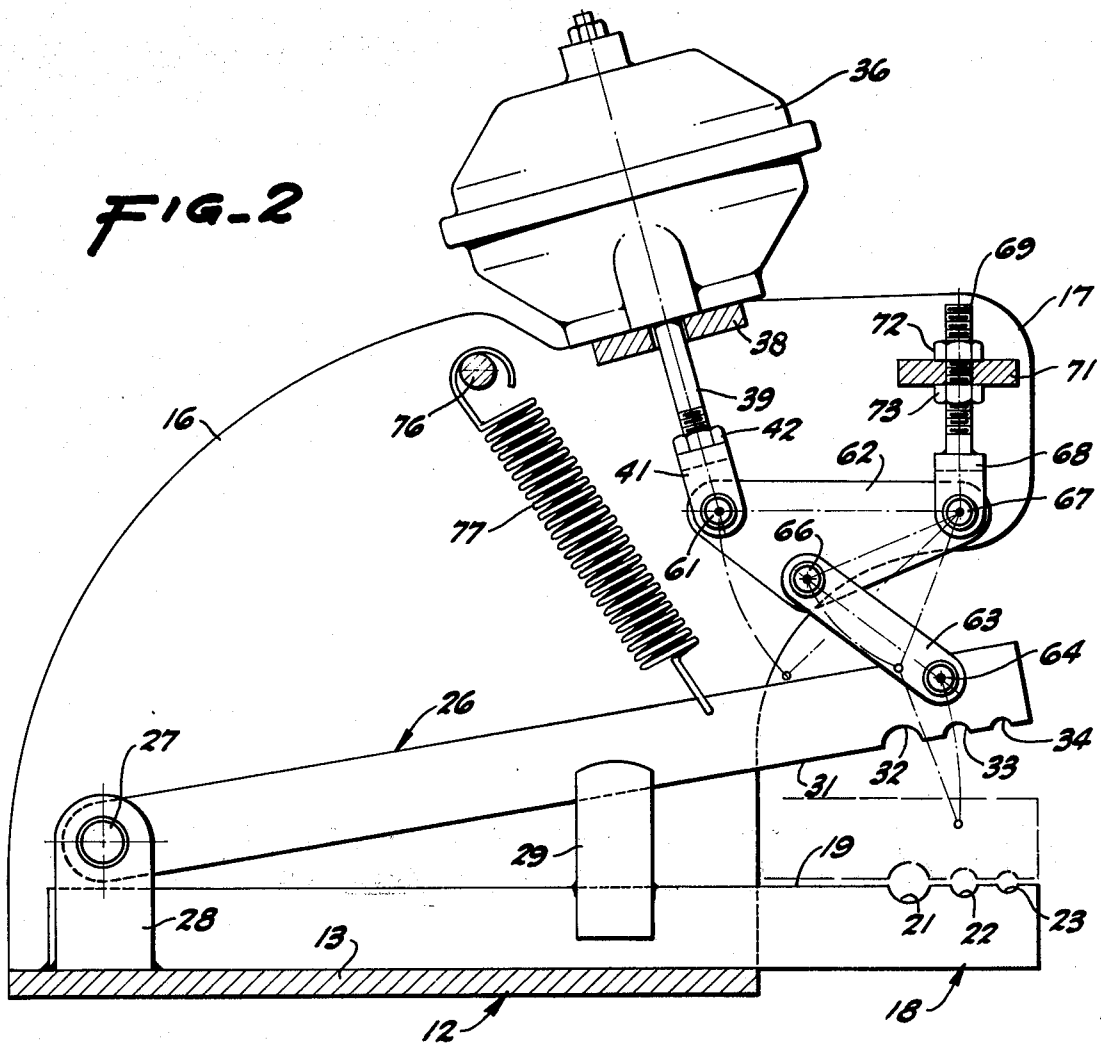
FIG. 2 is a cross-section, the planes of which are indicated by the lines 2 — 2 of FIG. 1.
Figure 3:
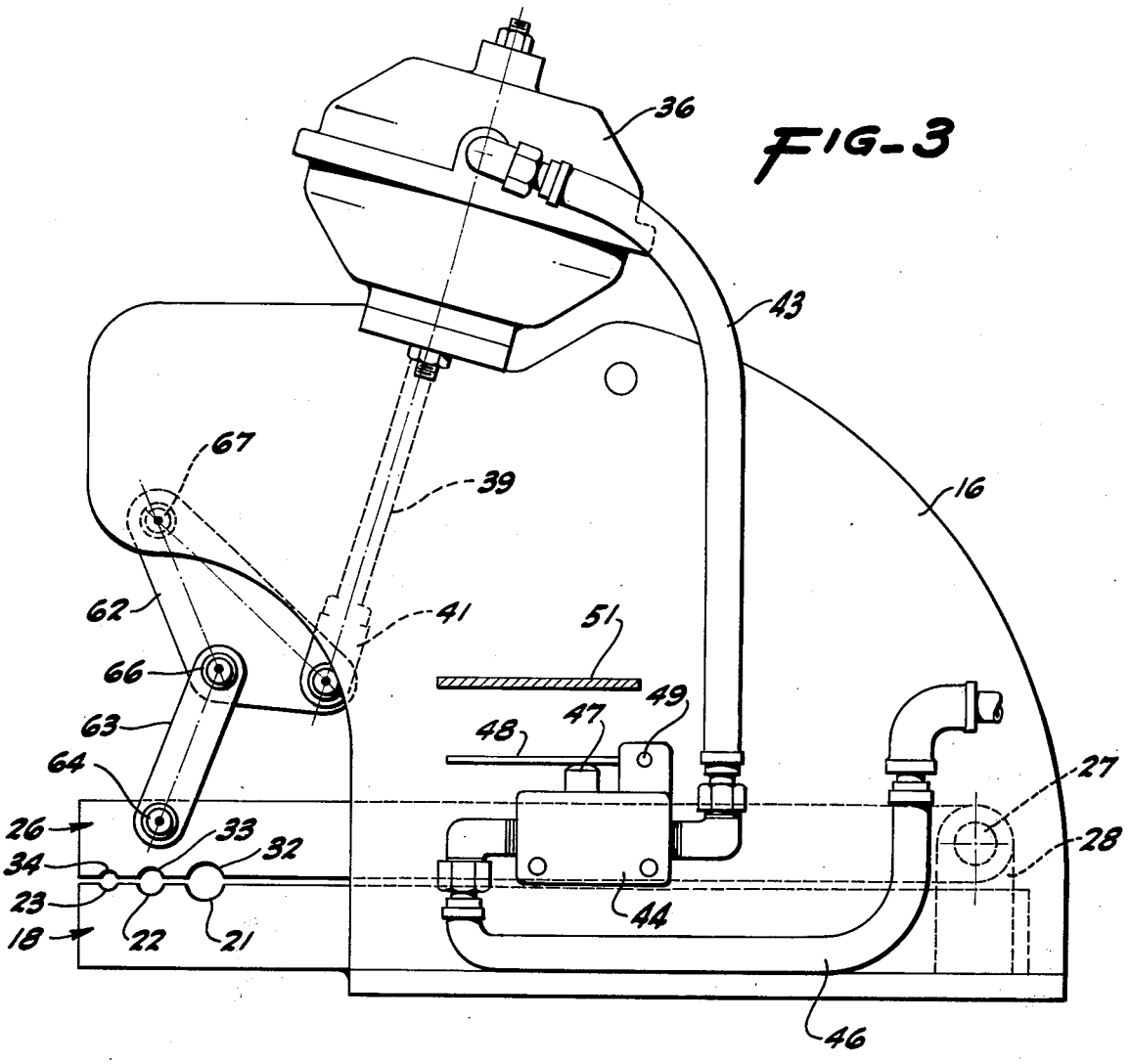
FIG. 3 is also a cross-section, the plane of which is indicated by the line 3 — 3 of FIG. 1.

The relationship of the toggle links 62 and 63 is of considerable importance. In order to allow some variance therein, the link 62 is made in a generally triangular shape and the link 62 also serves as a mounting for a fourth pivot pin 67. This not only engages the first link 62 but also is fitted into a clevis 68 at one end of an adjusting rod 69. The rod is selectively positioned on the frame 12 by a chosen interengagement with a cross strap 71 forming part of the frame and spanning the space between the plates 14 and 16. The rod 69 is held in any selected position by jam nuts 72 and 73. Movement of the rod 69 in a generally vertical direction, as seen in FIG. 2, moves the fourth pivot pin 67 and rocks the first link 62 thus changing the position of the second toggle links 63 and varying the alignment of the second pin 64, the third pin 66 and the fourth pin 67.

Since the power driver 36 is usually a one-way mechanism or commercially is provided with only a relatively weak spring for return motion, there is conveniently provided on a cross bar 76 on the frame 12 a coil spring 77 also hooked into the lever 26 and exerting a force opposite the downward force of the energized power driver and thus effective to restore the parts to their starting position.

In the preferred manner of operating the device, there is provided a pipe 6 with a hose 7 telescoped therewith and with a rather loose fitting 8 disposed around the hose and still overlying the interior pipe 6. The subassembly is brought between the extending portions of the anvil 18 and the raised lever 26. Depending upon its size, the initial ring 8 is positioned in the space between the dies 21 and 32 or the dies 22 and 33 or the dies 23 and 34.

The position of the threaded rod 69 having previously been properly established, the user depresses the control plate 48 thus supplying the power driver with force to project the rod 39. This movement of the rod rocks the first link 62 in a counterclockwise direction about the fourth pin 67 as a pivot and so rocks the link pair 63 in a clockwise direction about the pin 64 as a center. This motion, as illustrated by the broken lines in FIG. 2, moves the lever 26 in a clockwise direction toward the anvil.

In approaching the anvil, the die portions of the lever and anvil engage the relatively large ring 8 and deform it substantially into the shape shown in FIG. 4, providing a close encompassing of the hose 7 and even compressing the hose onto and around the pipe 6. The result of the deformation of the initially circular ring is not only to make the fitting tight upon the hose 7 but likewise to form the extending fins 9 and 10.

The final shape of the fins; that is, the amount they are deformed, extruded, thinned and pressed into immediacy is controlled by the position of the lever 26 relative to the anvil 18. By adjusting the rod 69 and the lock nuts 72 and 73 very carefully, the lever is made to approach the anvil as closely as desired or to a predetermined distance from the anvil or to leave a predetermined space therebetween. That space is exactly related to the desired final configuration and thickness of the fins 9 and 10 as they themselves lie against the planar surfaces 19 and 31, whereas the central portion or final ringlike portion of the fitting is fixed in size and configuration by the opposite die portions 21 and 32, for example.

The amount of approach of the lever to the anvil and the predetermined amount of space between the planar surfaces 19 and 31 is entirely fixed by the extent of linearity of the pins 67, 64 and 66. This is arranged so that the pins 67, 66 and 64 come near to a straight line relationship but not quite into a full toggle or straight line relationship. One setting is as shown by the broken lines in FIG. 2. This mechanism accurately controls, time after time, the exact amount of approach of the lever to the die so that repeated operations on repeated fittings produce the samd deformations and results.

One of the reasons for not permitting the pins 67, 64 and 66 to come into final toggle alignment is that to do so would tend to lock the mechanism against restoration. There is sufficient link angularity left when the lever approaches the anvil so that when pressure is released from the power driver 36 by manually releasing the plate 48, the spring 77 together with any standard spring within the power driver 36 collapses the toggle links 62 and 63 toward the full line position in FIG. 2, moves the pins 67, 64 and 66 farther away from any straight line position ready for a subsequent operation. The completed fitting 8 and its appurtenances 6 and 7 are easily removed from the vicinity of the overhanging portion of the anvil and lever since they are freely spaced from the rest of the machinery. The next fitting is as easily introduced for a similar crimping operation.

Figure 1:
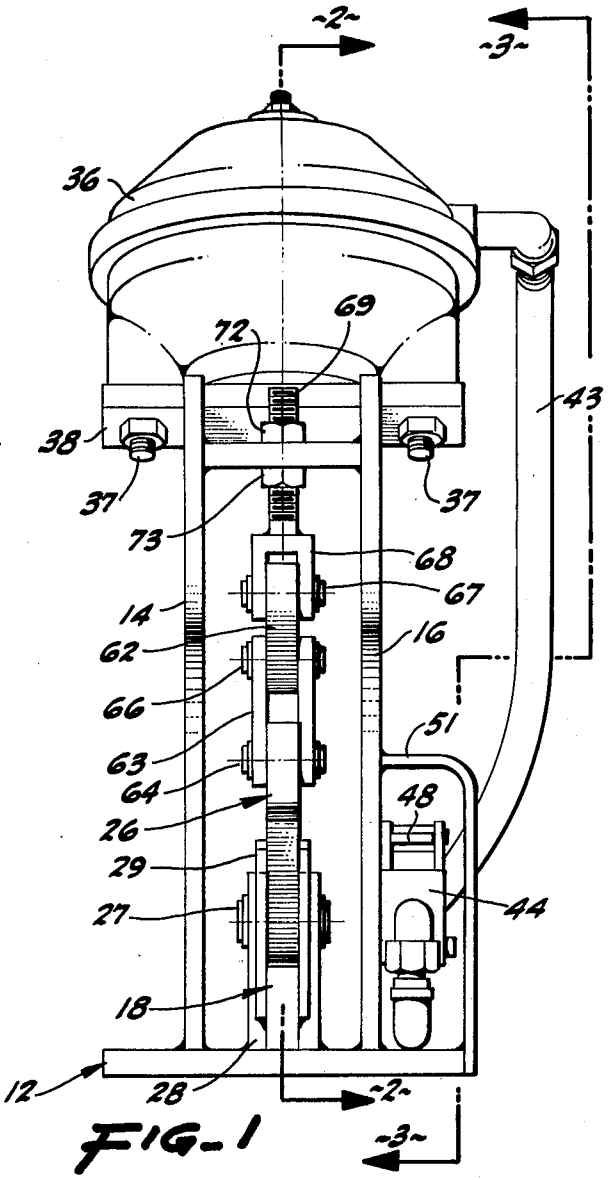
FIG. 1 is a front elevation of the power crimping tool of the invention.

In the interests of safety it is desirable that both of the operator's hands be well removed from the crimping station at the time the control plate 48 is depressed so as to move the lever 26 toward the anvil 18. One hand is necessarily removed from the crimping station in order to depress the control plate 48 shown on the right hand side of the tool, as appears in FIG. 1. The other hand must also be moved out of the danger zone by providing a second control valve 44 and control plate 48, not shown, on the left hand side of the tool. The two control valves are connected in series in the compressed air line 46 so that both control plates must be simultaneously depressed in order to actuate the lever 26, thereby assuring that both hands are well in the clear.

What is claimed is:

1. A power crimping tool comprising:

a. a base;

b. an anvil mounted on said base and having a first planar surface;

c. means defining at least a first die configuration in said anvil merging with said first planar surface;

d. a lever having a second planar surface;

e. means defining at least a second die configuration in said lever merging with said second planar surface;

f. means for mounting said lever to pivot on said base between two positions in one of which said first die configuration and said second die configuration are in substantially confronting registry;

g. a power driver on said base;

h. a toggle linkage including two links and four pivot pins;

i. means for connecting the first of said pivot pins to said power driver;

j. means for connecting the second of said pivot pins to said lever;

k. means for connecting the third of said pivot pins to both of said links; and, 1. means for connecting the fourth of said pins to said base for adjusting motion relative thereto, said means for connecting said fourth of said pivot pins to said base including a screw adjuster and being effective to dispose said second, third and fourth of said pins just out of a straight line relationship.

2. A power crimping tool as in claim 1 in which said means for connecting said fourth of said pivot pins to said base is movable into a position in which said lever and said anvil occupy an approached position with said first planar surface and said second planar surface a predetermined distance apart.

3. A device as in claim 1 including a spring connected to said lever and to said base for urging said lever and said anvil apart.

4. A device as in claim 1 including guides upstanding from said base and in substantial engagement with opposite sides of said lever.

5. A device as in claim 1 in which said anvil and said lever have portions projecting away from and outstanding from said base.

6. A device as in claim 1 in which said power driver is an air-expansible chamber, means for supplying said chamber with air under pressure, means including a manual operator for controlling said supplying means, and a guard affording only limited manual access to said operator.

7. A device as in claim 1 in which said first planar surface and said first die configuration, and said second planar surface and said second die configuration are disposed relative to each other in one position of said lever relative to said anvil to receive and closely abut a fitting having the configuration of a ring with a pair of oppositely extending fins disposed on a ring diameter.

* * * * *